US010351217B2

(12) United States Patent
Crupi

(10) Patent No.: US 10,351,217 B2
(45) Date of Patent: Jul. 16, 2019

(54) METHOD FOR ATTENUATING THE OSCILLATION OF A SHIP

(71) Applicant: P.S.C. ENGINEERING, Turin (IT)

(72) Inventor: Santino Crupi, Turin (IT)

(73) Assignee: P.S.C. ENGINEERING, Torino (IT)

( * ) Notice: Subject to any disclaimer, the term of this patent is extended or adjusted under 35 U.S.C. 154(b) by 0 days.

(21) Appl. No.: 16/068,516

(22) PCT Filed: Dec. 16, 2016

(86) PCT No.: PCT/IT2016/000297

§ 371 (c)(1),
(2) Date: Jul. 6, 2018

(87) PCT Pub. No.: WO2017/119008

PCT Pub. Date: Jul. 13, 2017

(65) Prior Publication Data

US 2019/0023361 A1 Jan. 24, 2019

(30) Foreign Application Priority Data

Jan. 7, 2016 (IT) ..... UB2016A9851

(51) Int. Cl.
*B63B 39/06* (2006.01)

(52) U.S. Cl.
CPC ..... *B63B 39/062* (2013.01); *B63B 39/06* (2013.01); *B63B 2039/065* (2013.01)

(58) Field of Classification Search
CPC .. B63B 39/062; B63B 39/06; B63B 2039/065
See application file for complete search history.

(56) References Cited

U.S. PATENT DOCUMENTS 6,062,159 A * 5/2000 Cao ..... B63B 1/107 114/123
2011/0017114 A1* 1/2011 Koop ..... B63B 39/06 114/122
2013/0319312 A1* 12/2013 Cappiello ..... B63B 39/06 114/122
2016/0121978 A1 5/2016 Venables et al.

FOREIGN PATENT DOCUMENTS

EP 1498348 A1 1/2005
EP 2782822 B1 10/2014
WO 2009083892 A2 7/2009

* cited by examiner

*Primary Examiner* — Stephen P Avila
(74) *Attorney, Agent, or Firm* — Jacob M. Ward; Ward Law Office LLC

(57) ABSTRACT

A method is described for attenuating the oscillation of a ship, which includes a controller of a drive adapted to move at least one fin to allow stabilizing the ship, when the ship is at zero speed, anchored, wherein the motion of such at least one fin comprises an initial acceleration step, an intermediate step at constant speed and a final deceleration step. In the initial acceleration step, such at least one fin can start from a first angular position, while in the final deceleration step, such at least one fin can reach a second angular position corresponding to minimum or null values of effects opposite to those of the acceleration and constant speed steps of such at least one fin to allow maximizing the useful roll moment generated by such at least one fin.

9 Claims, 6 Drawing Sheets

METHOD FOR ATTENUATING THE OSCILLATION OF A SHIP

CROSS-REFERENCE TO RELATED APPLICATIONS

This application is a National Stage of International Application No. PCT/IT2016/000297, filed on Dec. 16, 2016, which claims priority to Italian Patent Applicant No. UB2016A009851, filed on Jan. 7, 2016, the entire disclosures of which are hereby incorporated herein by reference.

FIELD

The present invention refers to a method for attenuating the oscillation of a ship.

BACKGROUND

In particular, the present invention refers to a method for attenuating the oscillation of a ship through stabilizing fins or other slewing devices which perform their function through a rotation.

Systems and facilities are known to decrease pitch, roll, jolt, undesired ship movements, in addition to apparatuses for measuring the oscillating behaviour of the ship.

Generally, an anti-roll device for a ship comprises at least due fins connected to the ship hull, which are capable of reducing ship motions at a zero ship speed, also called anchored ship, and for a navigating ship. The anti-roll device is such that its fins comprise at least one mobile hydrodynamic appendix.

Several shapes of fins are known, among which those with two axes.

In particular, patent EP2782822B1 discloses a device for actively stabilizing a ship, wherein the ship in a first operating state moves and in a second operating state stops, or is anchored. The device comprises at least one element with a wing profile connected to a drive. Such element with wing profile is connected to the ship hull through a hinge mechanism which is configured for rotating the element with wing profile, through a rotation around a first and/or a second rotation axis, from an inactive position, wherein at least one surface of the element with wing profile is substantially parallel and near to the external side of the ship, to an operating position, wherein the element with wing profile is projecting with respect to the external side of the ship.

The prior art is also given by WO2009083892A2 and EP1498348A1.

Both EP2782822B1, and the prior art in general do not deal with the problem of the negative contribution of decelerating effects, of a relevant order of magnitude with respect to accelerating and viscous effects deriving from the rotation of the stabilizing fins, above all under null speed conditions of the ship, or anchored ship.

As will be explained below in the following description of the present invention, FIG. 1 schematically shows a ship with the right fin. Only the right fin is shown, with sizes and positions related to the ship, as an example. The fin is shown in the null attack angle position. The concept of attack angle, valid when the ship is navigating, is used to identify the zero position of the fin.

FIG. 2 shows the use of the fin, according to the prior art, for the anchored stabilization. With respect to the zero position schematically shown in FIG. 1, the fin is rotated by a maximum angle of ±60° around the zero position. The rotation of the fin, with zero ship speed, is capable of developing a roll moment which can reduce the ship motions.

The stabilization through fins of the anchored roll, or a zero or low ship speeds, uses the fins through rotation with a maximum angle range of about ±60° with respect to the zero position.

The fin rotation speed generates a force perpendicular to the fin. This force produces a roll moment on the ship which is proportional to the cosine of the fin angle measured with respect to zero.

The angle assumed by the fin is null when the fin is parallel to the main axis of the ship, as shown in FIG. 1.

The generated roll moment, assuming a rotation of the fin at constant speed on all 360° which produces a constant force, is proportional to the cosine of the fin angle. Being the cosine null at ±90° of the fin angle, the generated roll moment in these points is null, and in these points the rotation of the fin generates a prow moment. The roll moment generated by the rotation of the fin is maximum for fin angles equal to 0° and to 180°.

FIG. 3 shows the side view of the right fin of a ship, right prow and left stern on the drawing. The curve shows the multiplying factor, cosine of the fin angle: such factor is maximum for a fin angle equal to 0° and to 180° and is null when the fin assumes angles +90° and −90°. The curve as function of the fin angle represents, with a polar diagram, the multiplying factor due to the fin angle in creating the roll moment. The roll moment generated by the rotation of the fin, when this latter one perform an excursion, from a starting angle to a final angle, to be able to perform the anchored stabilization, as non-limiting example, in a fin angle range of ±30° and a stroke between −30° and +30°, depends on the force of the generated fin, while the fin performs the stroke with a first acceleration step, a second step at constant speed and a third deceleration step. Such generated force is approximately of the shape in FIG. 4.

In the acceleration step A, and in the deceleration step C, the inertial forces prevail on the resistance forces, namely the force generated by the fin in step B made at constant speed. The inertial force in the acceleration step A is of the same sign as the resistance force B, at constant speed; the inertial force developed by the fin in the deceleration step C, has an opposite sign to the resistance force, step B at constant speed. Being higher than the resistance force, the global force, in the deceleration step, has an opposite sign to the other two steps. Therefore, if the first two steps A, B, acceleration and constant speed, provide a roll moment which brakes the roll motion of the ship, the last deceleration step C provides a roll moment which contributes to increase the roll itself, and is therefore harmful as regards the roll stabilization.

FIG. 5 shows the approximate behaviour of the roll moment with a fin stroke from −30° to +30°. The fin stroke is approximate and not limiting; there is a similar shape with a stroke from −40° to +40° and for a stroke from −60° to +60°.

The roll moment is obtained from the force developed by the fin multiplied by the arm and multiplied the cosine of the fin angle itself. Depending on the fin angle, the roll moment, generated by the fin, in the stroke between −30° and +30° is as shown in FIG. 6.

SUMMARY

During the deceleration step C of the fin to go to 30°, the generated roll moment is opposite to that of the two acceleration A and constant speed B steps. Therefore, the roll moment generated in the deceleration step C does not help stopping the roll movement of the ship, but contributes to increase it, limiting the effect of the acceleration A and constant speed B steps for the fin.

Object of the present invention is solving the above prior art problems, by providing a stabilization governed in such a way as to allow deleting or reducing the inertial effects in the fin deceleration step, when these effects are major or important with respect to the effects of the steps which reduce the roll motion of the ship.

A further object is being able to increase the useful effect generated by the fin with respect to the current art.

A further object is controlling the roll, pitch and jolt (vertical) disturbances, in a combined way or individually.

In particular, the problem to be solves is controlling the anchored ship roll, through an efficient system which further reduces the roll currently present due to a limited angular excursion in a range of +/−60° of the fins used in the prior art.

The above and other objects and advantages of the invention, as will appear from the following description, are obtained with a method for attenuating the oscillation of a ship as claimed in claim 1. Preferred embodiments and non-trivial variations of the present invention are the subject matter of the dependent claims.

It is intended that all enclosed claims are an integral part of the present description.

DRAWINGS

It will be immediately obvious that numerous variations and modifications (for example related to shape, sizes, arrangements and parts with equivalent functionality) could be made to what is described, without departing from the scope of the invention as appears from the enclosed claims.

The present invention will be better described by some preferred embodiments thereof, provided as a non-limiting example, with reference to the enclosed drawings, in which.

DETAILED DESCRIPTION

Figure 1:
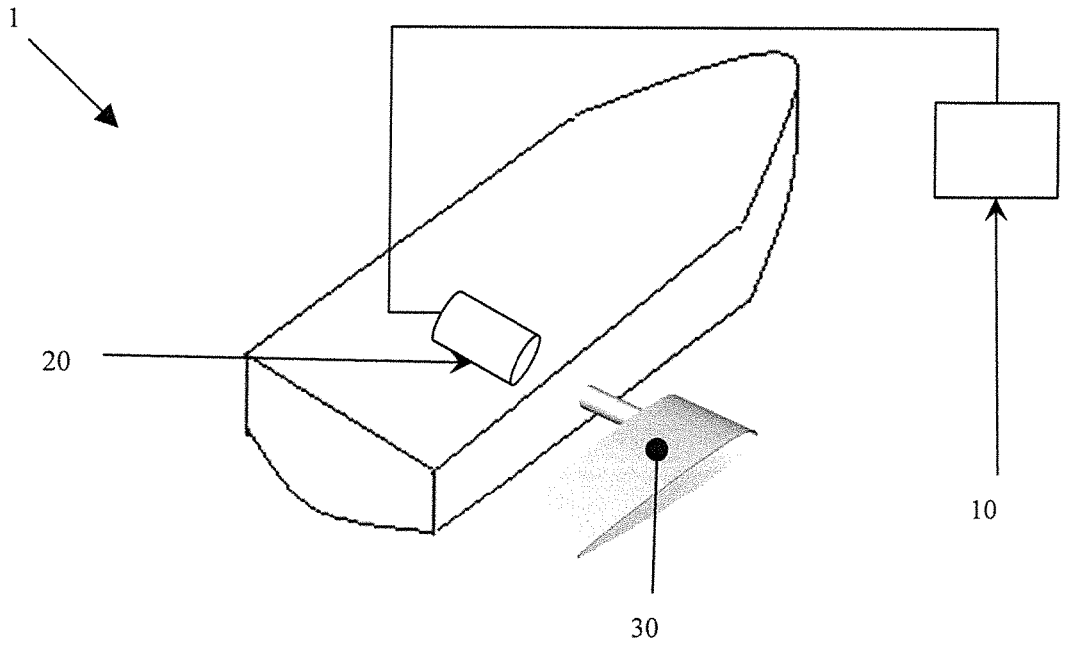
FIG. 1 shows a schematic view of a ship with the right fin, according to the prior art.
Figure 2:
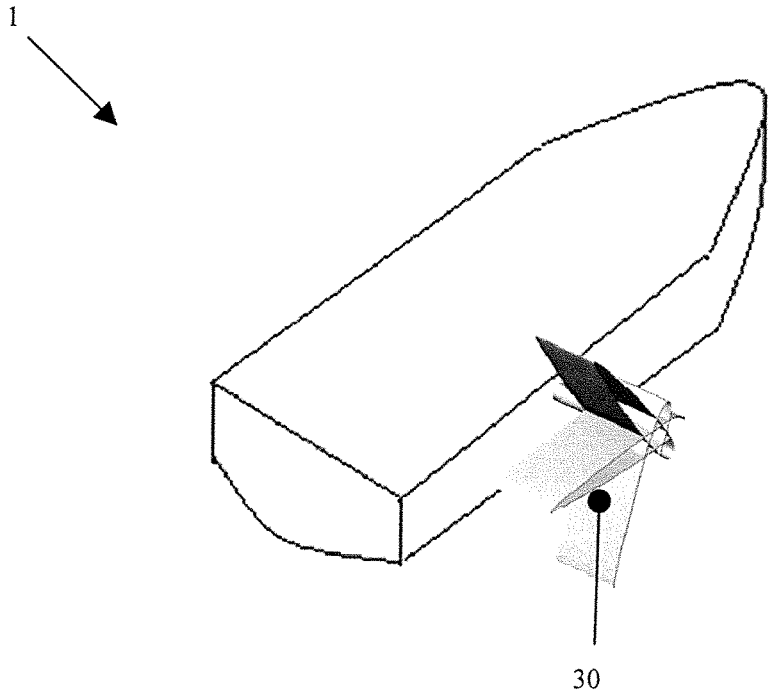
FIG. 2 shows a schematic view about the use of the fin of FIG. 1.
Figure 3:
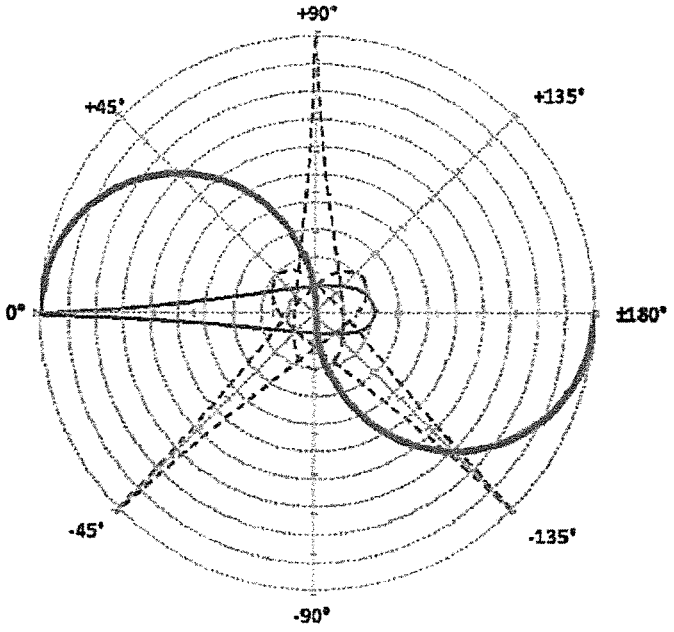
FIG. 3 shows the side view of the right fin of a ship, stern on the right and prow on the left of the sheet and the curve of the multiplying factor of the force developed to obtain the roll moment, cosine of the fin angle, according to the prior art.
Figure 4:
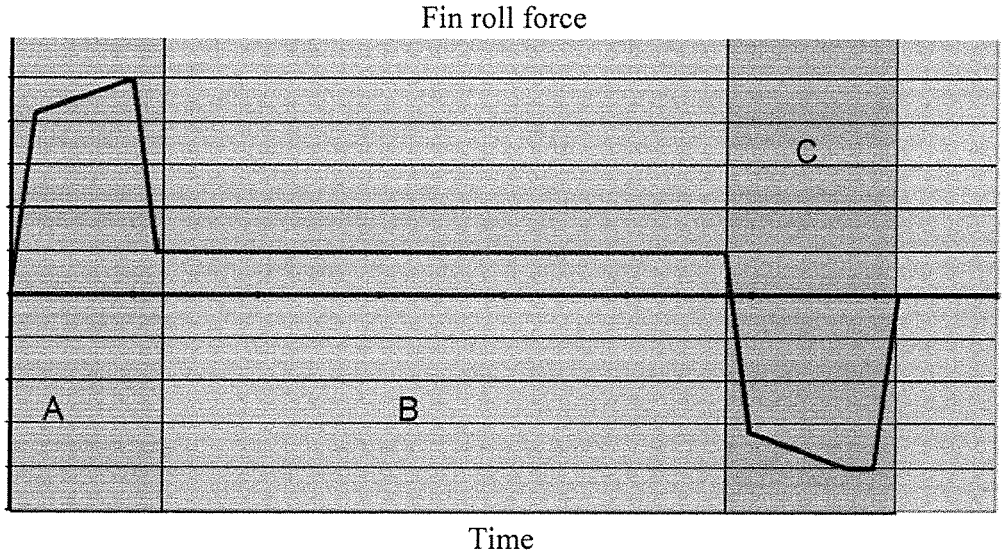
FIG. 4 shows the curve of the fin force generated when the fin performs the stroke with a first acceleration step, a second step at constant speed and a third deceleration step, according to the prior art.
Figure 5:
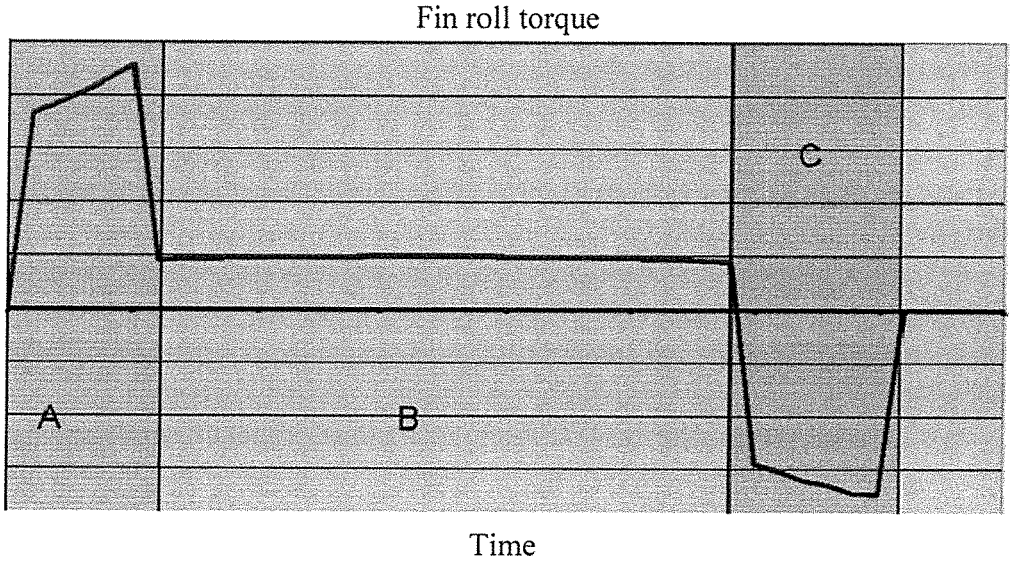
FIG. 5 shows the approximate behaviour of the roll moment depending on time, according to the prior art.
Figure 6:
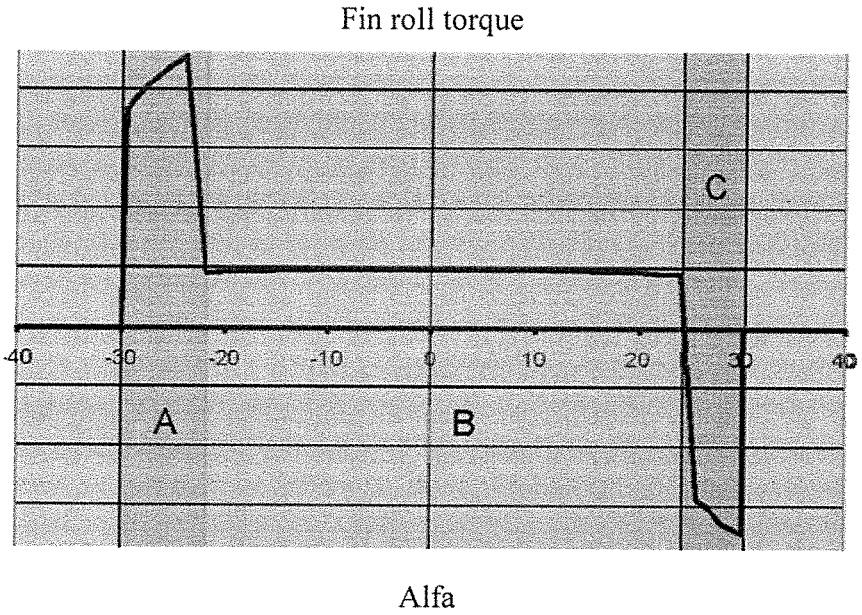
FIG. 6 shows the approximate behaviour of the roll moment with a fin stroke from −30° to +30°, according to the prior art.

With reference to FIG. 1, it is possible to note that a method for attenuating the oscillation deals with a ship 1, comprising a controller 10 of a drive 20 adapted to move at least one fin 30 to allow stabilizing the ship 1, when the ship is anchored, at zero speed.

With reference to FIGS. 3 to 6, the motion of such at least one fin 30 comprises an initial acceleration step, an intermediate step at constant speed and a final deceleration step.

Advantageously, in the initial acceleration step, such at least one fin 30 can start from a first angular position A1min, while in the final deceleration step, such at least one fin 30 can reach a second angular position A1max, A2max. In particular, the second angular position A1max, A2max corresponds to minimum or null values of effects opposite to those of the acceleration and constant speed steps of the fin 30 to allow maximizing the useful roll moment generated by the fin 30.

In particular, such at least one fin 30 can perform a wider rotation at an angular opening included between −60° and +60° and a rotation greater than one round angle.

Figure 7:
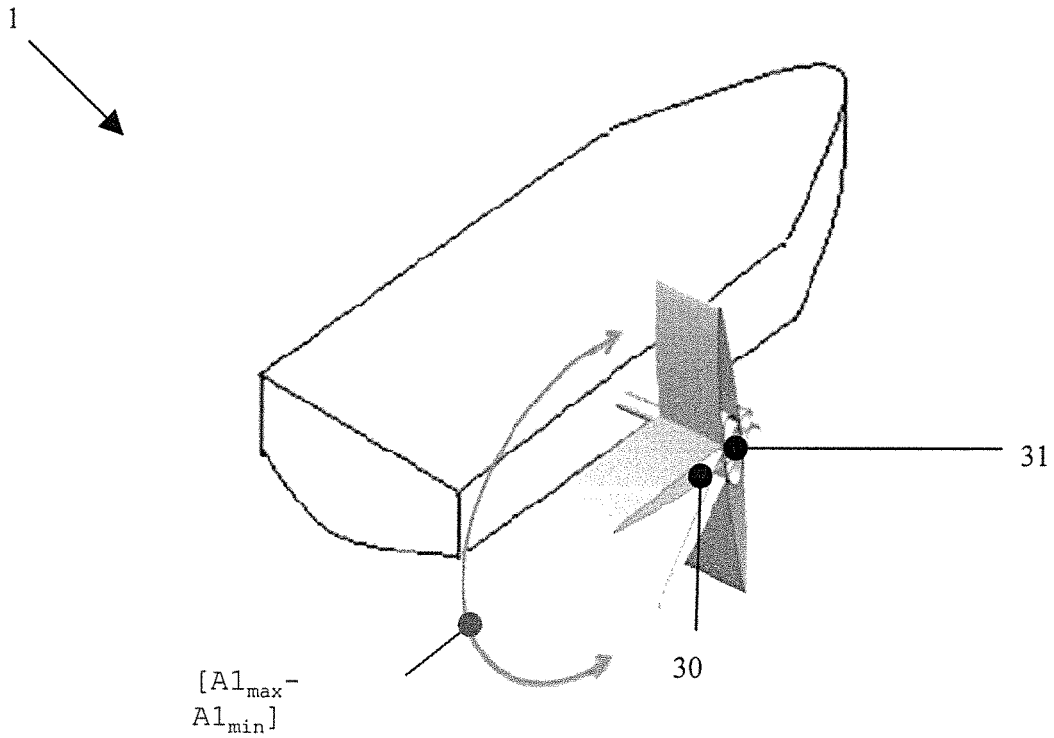
FIG. 7 shows a first configuration for applying the method for attenuating the roll oscillation of a ship, according to the present invention.

With reference to FIG. 7, when the ship 1 is anchored, at zero speed, the second angular position A1max corresponds to an inclination of +90° of the fin 30, with respect to a main axis of the ship 1, to be able to remove the inertial braking effects with respect to the resistance effects generated in the step at constant speed, cancelling the roll moment developed by the fin 30 in the final deceleration step, with respect to a rotation axis 31 of the fin 30.

Figure 8:
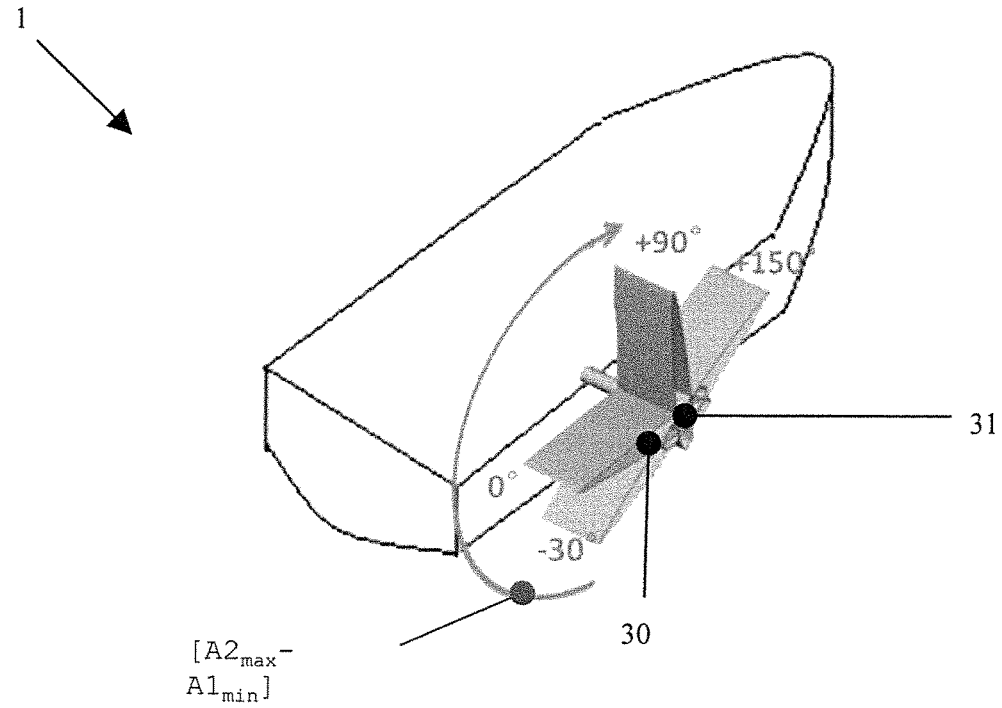
FIG. 8 shows a second configuration for applying the method for attenuating the roll oscillation of a ship, according to the present invention.

With reference to FIG. 8, the second maximum angular position A2max corresponds to an inclination of +150° of the fin 30, with respect to the main axis of the ship 1, to be able to make useful the inertial braking effects with respect to the inertial acceleration effects, compensating at least the oscillation moment of the intermediate step, included in an angular inclination between 90° and 150°, at constant speed, with respect to the rotation axis 31 of such at least one fin 30. The deceleration step provides the same contribution as the acceleration step of the fin. Only in the step at constant speed, identified with designation BB in FIG. 12, and corresponding to a fin angle included between 90° and 150°, the roll moment generated by the fin is opposite to the other steps.

Figure 9:
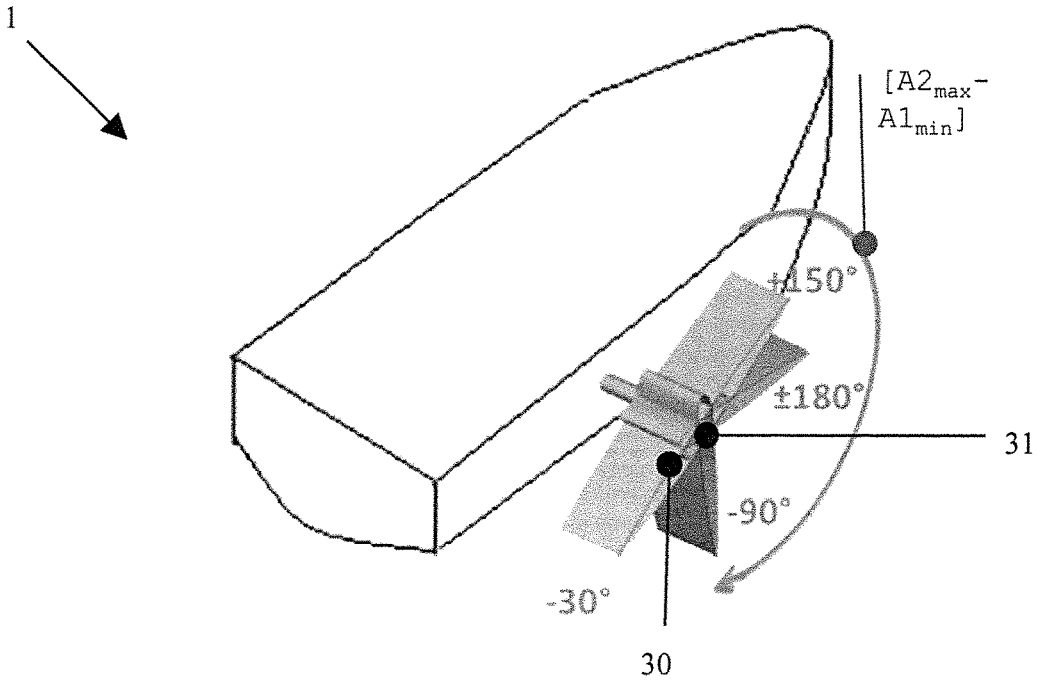
FIG. 9 shows a variation to the second configuration of the previous figure.
Figure 10:
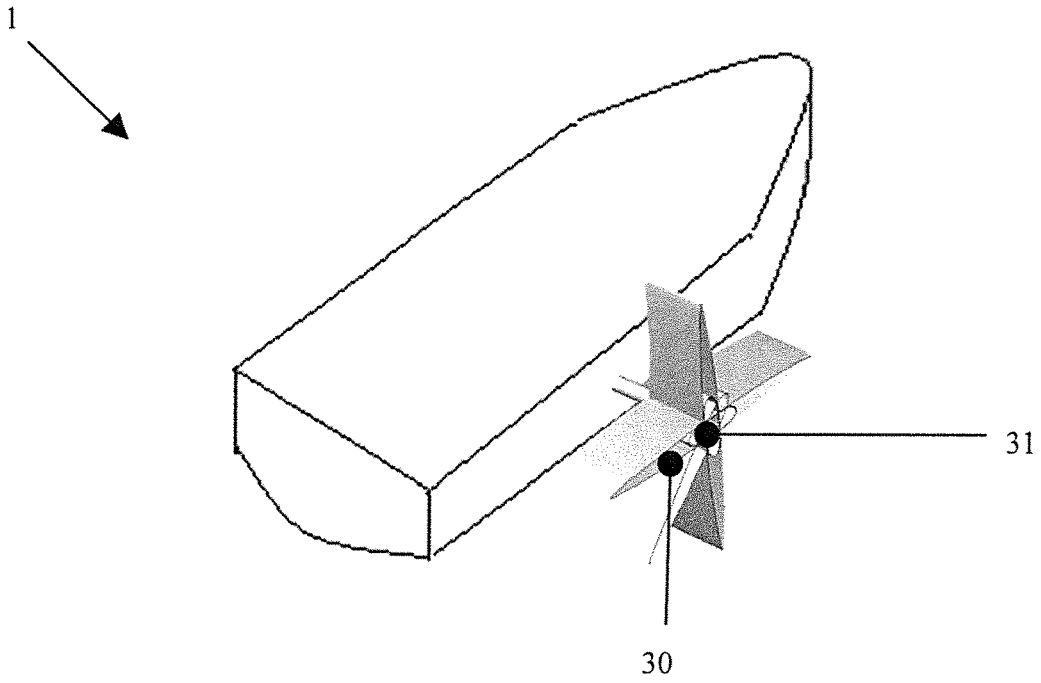
FIG. 10 shows a generic summarizing configuration for FIGS. 7, 8, 9.

With reference to FIG. 9, the fin 30 can move in an interval included between the second angular position A2max and the first angular position A1min, in the half-period following the roll oscillation.

The proposed method allows controlling roll, pitch and jolt of the ship 1, or only roll or only pitch or only jolt or combinations thereof, in a more efficient way, one with the same size of the fin 30, with respect to the prior art.

The fin 30 can belong to devices adapted to interact with a fluid, such as propellers, water jets, any device which uses a rotation of the direction of the generated force, systems which exploit the Magnus effect.

The method for attenuating the oscillation of a ship of the present invention, obtains the above stated objects.

In particular, the method allows an anchored stabilization, due to an extension of the fin rotation angle from ±60° to ±90° and with rotation on all 360°, in both clockwise and anticlockwise directions.

The method is based on the use of the fin with a rotation greater than the currently used range of ±60°. Actually, only a few manufacturers of fins are able to get these angles, the other ones limit themselves to a maximum excursion of ±45° around the zero position. Instead, the present invention takes into account a use of the fin with a rotation greater than the currently used one; in particular, the advantages is pointed out of using a rotation by ±90° around the zero position; a rotation by 180° from the starting position, 30° for example, of the fin to the final one, 150° for example, and also an extension to a complete rotation, 360°, in a clockwise and/or anticlockwise direction.

Figure 12:
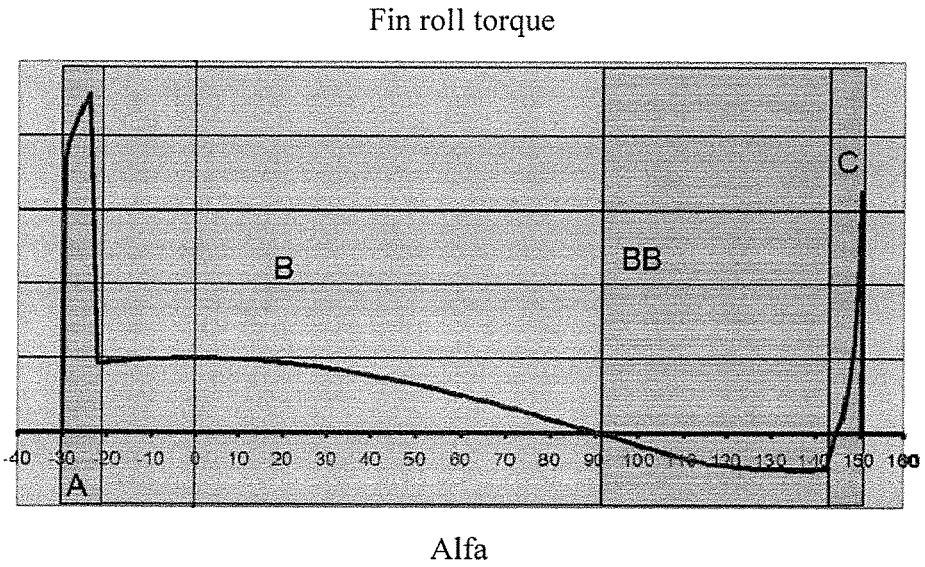
FIG. 12 shows the behaviour of the roll moment, depending on the fin inclination, in the second configuration of FIG. 8.

With reference to FIG. 12, the deceleration step produces a roll moment of the same sign of the acceleration step; the step at constant speed, identified as BB in the Figure, produces, with an angle included between 90° and 150°, a moment which is opposite to the other three area; a much smaller portion, with respect to the prior art, of roll moment is of the opposite sign to what is useful for stabilizing the roll motion of the ship.

In particular, FIG. 9 shows a variation to the second configuration of FIG. 8 and a completion of the fin rotation to compensate a roll period of the ship, in the second configuration; with a high roll motion, the fin performs a complete rotation, of 360° in a complete rotation of the roll angle of the ship.

With the electric actuation, a non-limiting example, it is easy to rotate the fin in a wider range with respect to the current normal range of ±60°. It is also possible to perform a continuous rotation on all 360°. Assuming a fin rotation at constant speed on all 360°, a non-limiting example used to understand the phenomenon, the force generated by the fin is constant.

During the deceleration step C of the fin to go to 30° (in the use from −30° to +30°), the generated roll moment is opposite to the one of the two deceleration A and constant speed B steps. Therefore, the roll moment generated in the deceleration step does not help stopping the roll movement of the ship, but contributes to increase it, limiting the effect of the acceleration and constant speed steps of the fin. If, instead of stopping the fin at 30°, one stops at 90°, there is a null roll moment, and therefore this negative effect is avoided for the deceleration step of the fin. The negative effect to the stabilization of anchored roll due to the fin braking step is cancelled if braking occurs with a fin angle around 90° (the factor due to the cosine of the fin angle is zero). With a greater rotation, final angle over 90°, the deceleration steps creates a roll moment with the same sign of the acceleration step.

Figure 11:
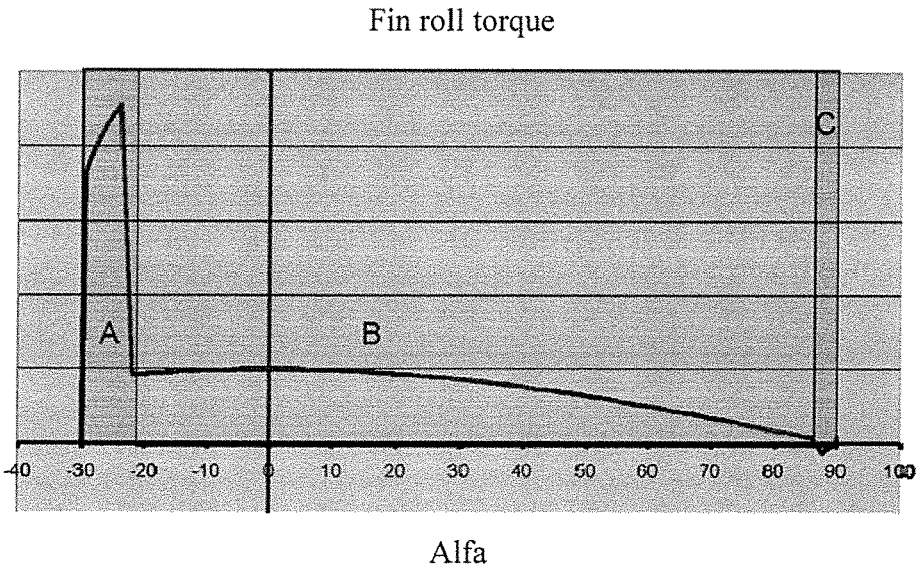
FIG. 11 shows the behaviour of the roll moment, depending on the fin inclination, in the first configuration of FIG. 7.

FIG. 11 shows the roll moment generated by the fin during its rotation between −30° and 90°. Remembering that the roll energy dissipated by this braking moment is proportional to the area subtended by this function, it can be observed that the dissipated energy is much greater in the rotation between −30° and 90° with respect to the currently used rotation, in the example between −30° and +30°, or wider strokes up to ±60°. The roll moment generated by the fin in the deceleration area is practically null and therefore does not negatively affect the stabilization task. Therefore, the wider fin rotation, between −30° and 90°, contributes to increase the dampening effect both due to the longer time of the roll moment and due to the absence of the negative part produced by the fin deceleration, next to 90° of the fin angle in step C.

If the fin is rotated up to about 150°, from −30° to +150°, the generated roll moment in the braking, deceleration step C has the same sign as the one in the two acceleration and constant speed steps A, B of the fin, till 90° are reached, FIG. 12. In this way, also the deceleration step C contributes to the reduction of the roll, compensating at least the roll moment part at constant speed, step BB, when the fin angle exceeds 90°, which remains opposite to the other steps.

With this use, the fin is ready to move in the range from +150° to −30° in the following half-period of roll, generating a force and its related roll moment which enables the reduction of the roll motion of the ship.

The rotation of the fin on all 360° allows dampening the roll motion, anchored or at null or small speed, in a better way with respect to a fin with a stroke in the range −60° to +60° with the same fin and rotation speed.

The rotation direction can also be clockwise or anticlockwise. Moreover, the fin, if enough for compensating the ship motion, continues to be used in the currently used normal range, ±60°; when the ship motions become wider, the widest rotation is used (between any greater range) or the one on all 360°. A similar reasoning is valid for the stabilization of anchored pitch or jolt motions of the ships: particularly sensitive are swaths, catamarans, equipped with four fins (surfaces) or other control devices (fixed propellers and propellers with oscillating axes) which allow generating a pitch moment (flap, propellers).

A synchronization of the fin angle with the roll angle of the ship allows generating a force (and consequently a roll moment) which reduces the roll motion of the ship. This innovation allows obtaining great improvements of the roll dampening with smaller fins than those currently installed on board, with the same ship. The reduction of fin sizes produces a reduction of resistances to advancement with benefits on fuel consumptions and pollution reduction. With the same fins, instead, higher comfort levels are obtained, with smaller ship motions with the same sea conditions.

This innovation is useful and can be applied to standard fins, but also to fins with two rotation axes described in the above patent EP2782822B1 or in the cylinder with Magnus effect. The use of the rotation around axis 4, see FIG. 1a-1b-1c shown in EP2782822B1 during the deceleration step, for the anchored stabilization, has the same developing feature of force (and roll moment) of the deceleration step of the fins: the developed moment is opposite with respect to the acceleration and rotation at constant speed steps, which serve for braking the roll motion of the ship. A blade rotation around the rotation axis 3 (traditional fin axis) simultaneous with the one around axis 4 avoids the generation of a roll moment opposite to the desired one; taking, with the rotation around axis 3, the blade of the fin in a vertical position (upwards oriented attack edge when the fin is in the lower part and vice versa in the top part). In this way, the negative effect of the motion deceleration around axis 5 is not present, and the roll moment developed by the fin in its classic extended rotation according to the present invention is also exploited. For a very efficient stabilization of the anchored roll, it is necessary that the motion around the axis parallel to the ship one, axis 4 in FIG. 1, is simultaneous with the rotation by 90° around axis 3 in the same Figure. In this way, the inertial forces in the braking part does not contribute to worsening the roll motion. In the deceleration part of the rotary motion around axis 4, without a rotation of the blade around axis 3 by 90°, the inertial forces due to deceleration contribute by generating a roll moment which is opposite to the one of the acceleration and constant rotation speed steps for the rotation around axis 4.

The rotation of the traditional axis of the fins, for surfaces with two axes, produces a further roll moment (and a pitch moment if the opposite surfaces are simultaneously used) which improves the stabilization capability.

The method for attenuating the oscillation of a ship of the present invention, strongly improves the anchored stabilization capability of the fin with two axes. This same innovation is applied for dampening the unmoving ship from its pitch, when the ship is equipped with four fins. The traditional fin or the fin with two axes, if they stop their stroke at an angle of 90° (the fin blade is vertical) does not generate a roll and pitch moment in the deceleration step. The rotation by 360°, with an half-stroke of 180°, allows reducing the roll and/or pitch motions also in the deceleration part of the fin or of the surface in general. The fin, or other device, can rotate with continuity on all 360° even without stops; it will rotate with a rotation speed adequate to the roll motion of the ship.

The shown fin is symmetrical and with a single axis, but can have a non-symmetrical profile and have an axis not of rotation only. The idea extends also to devices which generate the force through propellers, water jets and any device which uses a rotation of the direction of the generated force.

The idea can also be applied to systems which exploit the Magnus effect and which are currently installed in a similar position to fins on ships.

These rotating cylinders are horizontally oscillating from stern to prow and vice versa. If this device is centrally assembled, on the bottom, on the line of symmetry of the ship, it can be rotated by 360° for the anchored stabilization and when navigating.

In addition to the force developed due to Magnus effect, there is the weight of the cylinder which contributes to the stabilization during the fraction of time in which it is at 90° with respect to the main direction of the ship.

The fins can slew, in order to obtain the purpose of the roll (pitch and jolt) stabilization of roll, around the 180° position, instead of with respect to zero for the current art. The tilt around the 180° position allows stabilizing the roll (pitch and jolt) in backtrack; currently, when the ship moves backwards with respect to water, the fins are kept to zero and motions are not attenuated; this surely happens for backward speeds greater than 1 or 2 nodes.

With this solution, roll (pitch and jolt) motions of the ship are dampened also when the ship moves backwards. The ship moves backwards with respect to water in many situations, voluntary and not. Being unmoving with stern sea, being unmoving at the mouth of a river with stern ground, going voluntarily backwards implies a negative relative speed of the ship with respect to water.

The fins, during the motion for the anchored stabilization, also produce a longitudinal thrust, imposing a movement to the ship which, in some situations, must be compensated with appropriate actions. If the ship is equipped with four fins, then a pair of fins can be used with tilt around zero and the other pair with tilt around 180°. In this way, the longitudinal front and back thrusts of the pair of fins are opposite and the ship is not subjected to longitudinal movements, avoiding the intervention of other systems for keeping its position.

Also with two fins only, using a fin around zero and another around 180° reduces the longitudinal thrust.

The rotation on all 360° increases the effect of the fins for the anchored stabilization. In particular, this stroke extension also allows accelerating the fin speed till the areas where the acceleration provides a positive contribution to the roll dampening, and decelerating in the areas where the inertial contribution of the generated roll moment is smaller. Concentrating the angular acceleration of the fin around zero (and 180°) helps in the task of dampening the roll. How to concentrate the deceleration of the fin in the fin angle area around +90° and −90° reduces the negative effect of the inertial force to the anchored roll stabilization.

The invention claimed is:

1. A method for attenuating an oscillation of a ship, the ship comprising a controller of a drive adapted to rotate at least one fin, between a first angular position and a second angular position, in both clockwise and anticlockwise directions, to allow stabilizing the ship, when the ship is anchored, at zero speed, wherein the motion of the at least one fin comprises an initial acceleration step, an intermediate step at constant speed and a final deceleration step, wherein, in the initial acceleration step, the first angular position corresponds to an inclination of −30° of the at least one fin, with respect to a main axis of the ship, wherein the second angular position corresponds to an inclination of +90° of the at least one fin, with respect to the main axis of the ship cancelling a roll moment developed by the at least one fin in the final deceleration step.

2. The method of claim 1, wherein the second angular position corresponds to an inclination lower than +150° of the at least one fin, with respect to the main axis of the ship compensating for at least an oscillation moment of the intermediate step, included in an angular inclination between 90° and 150°, at constant speed, with respect to a rotation axis of the at least one fin.

3. The method of claim 2, wherein the at least one fin moves in an interval between the second angular position and the first angular position, in a half-period of a roll oscillation.

4. The method of claim 1, the method allowing one to control roll, pitch and jolt of the ship or only the roll or only the pitch or only the jolt or a combination thereof, with the same size of the fin.

5. The method of claim 4, wherein the at least one fin belongs to a device adapted to interact with a fluid, such as propellers, water jets, any device which uses a rotation of a direction of a generated force, or systems which exploit a Magnus effect.

6. The method of claim 1, the method providing for a stabilization of the anchored roll moment with a tilt around 180°, instead of with respect to zero.

7. The method of claim 1, the method providing for a stabilization of the roll moment in backtrack of the ship, with a tilt around 180°.

8. The method of claim 1, wherein, in the anchored stabilization, the ship is subjected to a thrust of the at least one fin longitudinally, generating an undesired displacement, if the ship has four fins, two fins being tilted around zero and two fins being tilted around 180°, removing in this way the longitudinal movement effect.

9. The method of claim 1, the method providing for a complete and continuous rotation of the at least one fin for the anchored stabilization for maximizing the effect of the at least one fin in the anchored stabilization.

* * * * *